US005400581A

United States Patent [19]

Jaeger

[11] Patent Number: 5,400,581

[45] Date of Patent: Mar. 28, 1995

[54] PROCESS AND DEVICE FOR THE REDUCTION OF ENERGY CONSUMPTION IN THE OPERATION OF SPINNING ELEMENTS

[75] Inventor: Wolfgang Jaeger, Goppingen, Germany

[73] Assignee: Rieter Ingolstadt Spinnereimaschinenbau AG, Ingolstadt, Germany

[21] Appl. No.: 30,235

[22] PCT Filed: Jul. 18, 1992

[86] PCT No.: PCT/EP92/01643

§ 371 Date: Jul. 12, 1993

§ 102(e) Date: Jul. 12, 1993

[87] PCT Pub. No.: WO93/03212

PCT Pub. Date: Feb. 18, 1993

[30] Foreign Application Priority Data

Jul. 27, 1991 [DE] Germany ..... 41 25 016.8
Jun. 12, 1992 [DE] Germany ..... 42 19 278.1

[51] Int. Cl.[6] ..... D01H 4/42; D01H 13/00

[52] U.S. Cl. ..... 57/264; 57/93; 57/104; 57/105; 57/263; 57/406

[58] Field of Search ..... 57/264, 406, 92, 93, 57/104, 105, 103, 263

[56] References Cited

U.S. PATENT DOCUMENTS

| | | | |
|---|---|---|---|
| 3,461,660 | 8/1969 | Nimtz et al. . | |
| 4,058,966 | 11/1977 | Raasch | 57/104 X |
| 4,150,530 | 4/1979 | Derichs | 57/264 X |
| 4,627,228 | 12/1986 | Wolf . | |
| 4,660,373 | 4/1987 | Derichs | 57/105 X |
| 4,760,688 | 8/1988 | Beitzinger | 57/92 |
| 4,785,618 | 11/1988 | Stahlecker | 57/264 |
| 4,916,891 | 4/1990 | Landwehrkamp et al. | 57/92 X |
| 5,069,027 | 12/1991 | Stahlecker et al. | 57/264 |

FOREIGN PATENT DOCUMENTS

| | | | |
|---|---|---|---|
| 0395880 | 11/1990 | European Pat. Off. . | |
| 1510840 | 1/1972 | Germany . | |
| 2042972 | 3/1972 | Germany . | |
| 2944219 | 7/1980 | Germany | 57/264 |
| 3413764A1 | 10/1985 | Germany . | |
| 3942402A1 | 6/1991 | Germany . | |
| 1382652 | 3/1973 | United Kingdom | 57/263 |
| 2109018 | 5/1983 | United Kingdom | 57/92 |
| 2109422 | 6/1983 | United Kingdom | 57/92 |

OTHER PUBLICATIONS

Autocoro 240 Article with Translation Jan. 1991 Nerstellung Feiner Rotorgarne.

*Primary Examiner*—Lenard A. Footland
*Assistant Examiner*—William Stryjewski
*Attorney, Agent, or Firm*—Dority & Manning

[57] ABSTRACT

The present invention provides a process and device for the reduction of energy consumption in operating spinning elements in driving spinning rotors of open-spinning machines or the spindle drive of ring spinning machine or the roving frame. It is the object of the invention to constantly keep energy consumption in the operation of spinning element at a minimum. Contact pressure between each spinning element and the indirect driving device is adjusted as a function of the momentary difference between the rotational speed of the spinning element and of its driving device in stationary operation while rotational speeds only nominally change, so that the slippage between indirect driving device and spinning element remains constant in time.

20 Claims, 3 Drawing Sheets

PROCESS AND DEVICE FOR THE REDUCTION OF ENERGY CONSUMPTION IN THE OPERATION OF SPINNING ELEMENTS

BACKGROUND OF THE INVENTION

The instant invention relates to a process and device for reducing energy consumption in the operation of spinning rotors of an open-end spinning machine or in the operation of the spindles of ring spinning machines or of the roving frame.

The spinning elements are considered, for example, to be spinning rotors and spindles. The drive of the spinning elements is designed so that indirect driving means (belts or drive disks) are pressed interlockingly against the driving surface assigned to the spinning element. This drive can also be designed so that a motor drives a group of spinning elements by means of a belt drive, or so that an indirect motorized individual drive is provided for each spinning element, whereby belts or driving disks are acting as indirect driving means.

It is known that a consumption of energy is expended as a result of the slip between spinning elements and their indirect driving means, and that this slip is not negligible from the point of view of energy consumption even when optimal production conditions are ensured. The admissible deviation in rotational speed for the nominal operation of the rotors lies within a tolerance range of approximately ±2% without affecting the product quality. The deviations of rotational speeds of the rotors from each other lie within a tolerance range of ±1.5%. From this, it appears clearly that due to the tolerance of the rotational speeds of rotors from each other the electric consumption is not minimal, especially when rotors are driven by group drives by means of belts and a drive motor. This situation increases the overall consumption of energy by the spinning machine since the duration of normal operation is very long as compared with run-up and stoppage.

DE-OS 39 42 402 describes a tangential belt drive of an open-end spinning machine in which the spinning rotors of several adjoining spinning units are driven. The described actuating mechanism is directed only upon the alternation between rotor, brake and pressure roller. This makes it possible to increase the contact pressure by an always constant value during the run-up of the spinning machine and to reduce it again as normal operation starts. This process is conditioned upon the action of a service carriage upon the common actuating mechanism of brake and pressure roller. The run-up phase takes place in a matter of seconds, so that the energy savings which can be obtained are minimal. Since the intervention of the automatic service carriage is necessary, the effect of energy savings applies in each instance only to one single rotor of the spinning machine, whereas the machine has, as a general rule, over 200 rotors. The actual economic result with respect to energy savings for the entire machine is very low. The total time for all piecing processes in a spinning machine per shift is considerably lower than the total time of yarn production per shift. It is therefore a disadvantage that no energy saving can be achieved with this solution for the entire time of yarn production of the spinning machine. For this critical period of time, the solution is absolutely unsuitable in achieving any kind of energy saving.

DE-OS 34 13 764 describes a device having similar disadvantages. The knowledge of these two solution is obviously insufficient to achieve energy savings with economic impact for the entire operating time of the machine per shift.

As stated in the article "Autocoro 240 for the production of fine rotor yarns", Chemiefasern/Textilindustrie, 41./93, January 1991, page 41, efforts to reduce energy consumption in a spinning machine have tended towards the utilization of rotors with smaller rotor diameters for instance, the control of drives with frequency reversers or the utilization of new twin disk bearings for the rotors. In the described solutions no possibilities are shown on how the conventional pressure roller may be used to contribute to a reduction of electrical consumption to a minimum during the entire time of production.

The solution according to DE-AS 15 10 840 achieved an improvement over the rigid pressure which is independent of rotational speed. It is, however, a disadvantage of this solution that the force of contact pressure is changed only centrally, i.e. simultaneously and uniformly at all pressure rollers. The existing tolerance (±1.5%) for the rotational speed difference between spinning elements for example, cannot be taken into consideration in any satisfactory manner for the reduction of energy consumption. It is furthermore disadvantageous for the contact pressure to be controlled only centrally, i.e. the reactions to adjustments cannot be recognized, and this results in energy loss for the individual spinning element because of the tolerance. Until now the existing tolerance has prevented any further lowering of energy consumption during spinning operation.

It is a known fact that due to the slippage between spinning elements and their indirect driving means energy consumption which is not minimal, even when optimal production conditions are ensured, continues to exist.

It would be possible to achieve considerable savings in three-shift operation of a spinning machine in the order of up to one fourth of present energy consumption for the rotor drive, if energy losses due to uncontrolled slip between rotor and indirect driving means can be avoided. The existing situation is especially aggravating because the time for normal operation is very long by comparison with operating states such as run-up or stoppage, and therefore exerts the decisive influence upon the potential energy savings.

OBJECTS AND SUMMARY OF THE INVENTION

It is a principal object of the instant invention to provide a process and device for constant keeping energy consumption to a minimum during operation of spinning elements.

Additional objects and advantages of the invention will be set forth in part in the description which follows, and in part will be obvious from the description or may be learned by practice of the invention.

The objects are attained with the present invention in that the contact pressure between spinning element and indirect driving means is controlled as a function of the momentary speed difference between the indirect driving means and spinning element in stationary operation when rotational speed is only nominally changed, i.e. the slip between spinning element and indirect driving means remains constant during operation or during required changes in rotational speed (e.g. during piecing). The constant pressure is individually controlled over time for each spinning element and is thus optimized.

According to the invention, the rotational speeds of the indirect driving means and that of the applicable spinning element are detected for each individual spinning element during operation or during change in rotational speed, are processed into a rotational speed difference and are transmitted to an individual control of the spinning element in order to control the contact pressure of the pressure means.

The optimal value of the difference in rotational speeds between indirect driving means and spinning element is used as a guide magnitude for the control circuit. This optimal value of the difference in rotational speeds is found empirically for each individual spinning element and is established as a set point. The actual value of the difference between the rotational speed of the driving means and the spinning element is constantly detected and is constantly compared with the given optimal value of the rotational-speed difference between driving means and spinning element.

When the difference in rotational speed deviates from the optimal value, the contact pressure of the pressure means as defined in relation to the indirect driving means or the spinning element is adjusted as a function of the control intensity via an amplifier. The result is a constant contact pressure which is adjusted for constant slip. This process is constant during the entire operation of the spinning element.

A further advantage to be achieved with this invention consists in particular in the fact that energy savings of up to 25% over the present conventional consumption of a spinning element drive can be proven in the operation of the spinning machine as an economically measurable advantage.

Furthermore, no changes in the process are required when going from normal operation to piecing operation, since minimum energy consumption in operation is achieved in each different mode of operation. Most of the energy savings result however from the normal spinning operation itself.

A further advantage consists in the fact that the function of the invention is independent of the slip differences occurring from spinning element to spinning element due to manufacturing tolerances and frictional values or to such influences as network voltage fluctuations.

The accompanying drawings, which are incorporated in and constitute a part of this specification, illustrate embodiments of the invention, not limitations of the invention and, together with the description, serve to explain the principles of the invention.

DESCRIPTION OF THE PREFERRED EMBODIMENTS

Figure 1:
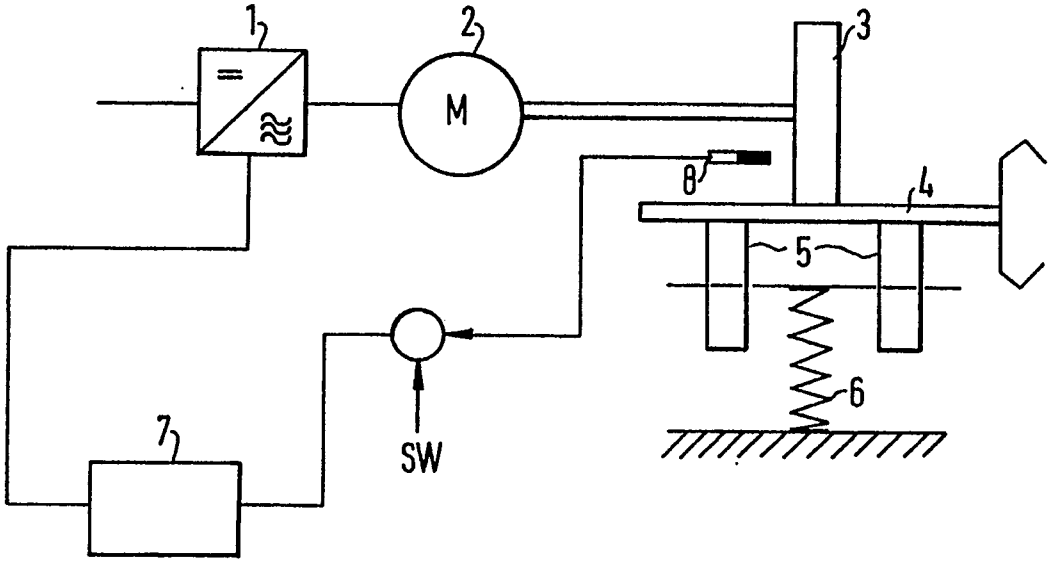
FIG. 1 is an example of the prior art solution, according to the state of the art and shows static pressing of the rotor shaft against the driving disk.

Reference will now be made in detail to the presently preferred embodiments of the invention, one or more examples of which are illustrated in the drawings. Each example is provided by way of explanation of the invention, not limitation of the invention. The numbering of components in the drawings is consistent throughout the application, with the same components having the same number in each of the drawings.

FIG. 1 shows an indirect individual drive of the rotor according to the state of the art. A known twin disk bearing is used here. As is known, the drive by electric motor is made up of the elements of inverted rectifier 1 and electric motor 2. The driving disk 3 is rigidly connected to the motor shaft. In the nip formed by driving disk 3 and a pair of supporting disks 5, the rotor shaft 4 and the rotor is supported and in contact. The supporting disks 5 are provided with a spring pressure 6. This spring pressure 6 according to FIG. 1 is exerted permanently with a constant spring force, so that the rotor shaft 4 is pressed permanently and with constant force against the drive disk 3. The rotational-speed sensor 8 records the momentary rotational speed of the drive disk 3 and supplies its rotational-speed values to a desired-value/actual-value SW comparator, i.e. the actual value of the rotational speed is compared with a desired rotational speed. The controller 7 functions on basis of the found control difference. The controller 7 is connected to the inverted rectifier 1. The rotational speed of the motor 2 is changed by the inverted rectifier 1 as a function of the magnitude of the control difference. The shown control circuit thus serves to control the rotational speed of the drive. The spring pressure 6 is static and is not connected to the control circuit.

Figure 2:
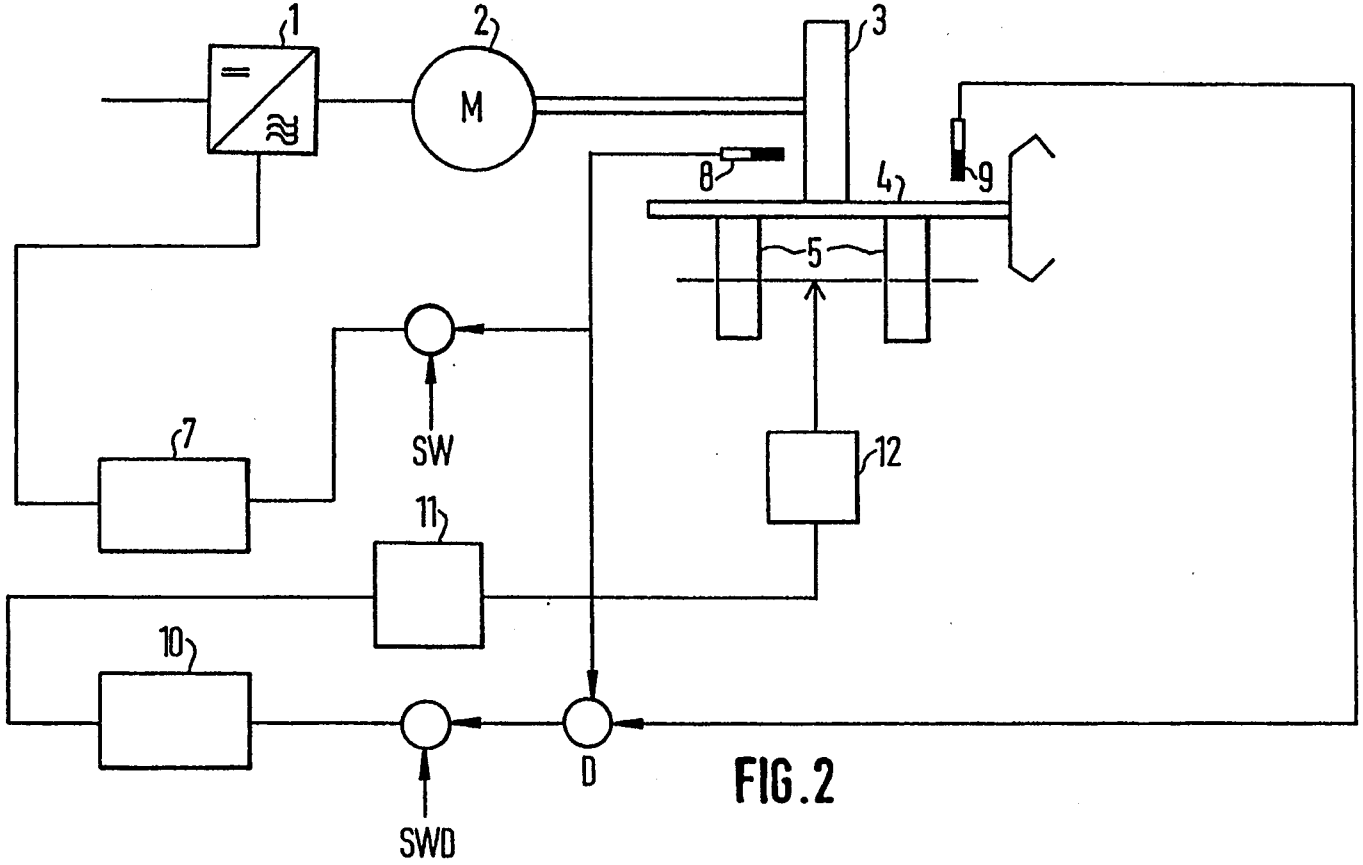
FIG. 2 shows a modular mimic display of the control of the contact pressure between rotor shaft and drive disk according to the present invention.

According to the present invention, indirect individual drive of a rotor using a twin disk bearing is the starting point in FIG. 2. A second control circuit is introduced in addition to the existing control circuit. The magnitude of adjustment in the second circuit is a difference in rotational speed. For this purpose the rotational-speed sensors 8 and 9 are connected via a difference former D and a set point—actual value comparator SWD to a regulator 10. According to the process an empirically determined optimal value of the difference in rotational speed between the speed of the driving disk 3 and the rotor shaft 4 is given as the set point of rotational speed difference SWD. Each of the rotational-speed sensors 8 and 9 permanently signals the present rotational speed of driving disk 3 and rotor shaft 4. The difference former D forms the difference between the rotational speed of the driving disk 3 and that of the rotor shaft 4. This difference value is an actual value which is compared with the set point of the rotational speed difference SWD. In case of positive or negative deviation (regulating difference) from the rotational speed difference SWD the amplifier 11 is actuated via regulator 10 in such manner that the contact pressure is increased or reduced accordingly via actuator 12. This permanent adjustment also ensures optimal operation dynamically. The actuator can be, for example, a hydraulic or pneumatic valve with working piston, serving as the contact pressure means, or an electric lifting magnet, whereby this assembly exerts the defined contact pressure upon the rotor shaft 4 via supporting disks 5 so that said rotor shaft 4 is constantly pressed against the driving disk 3 with a defined force.

Figure 3B:
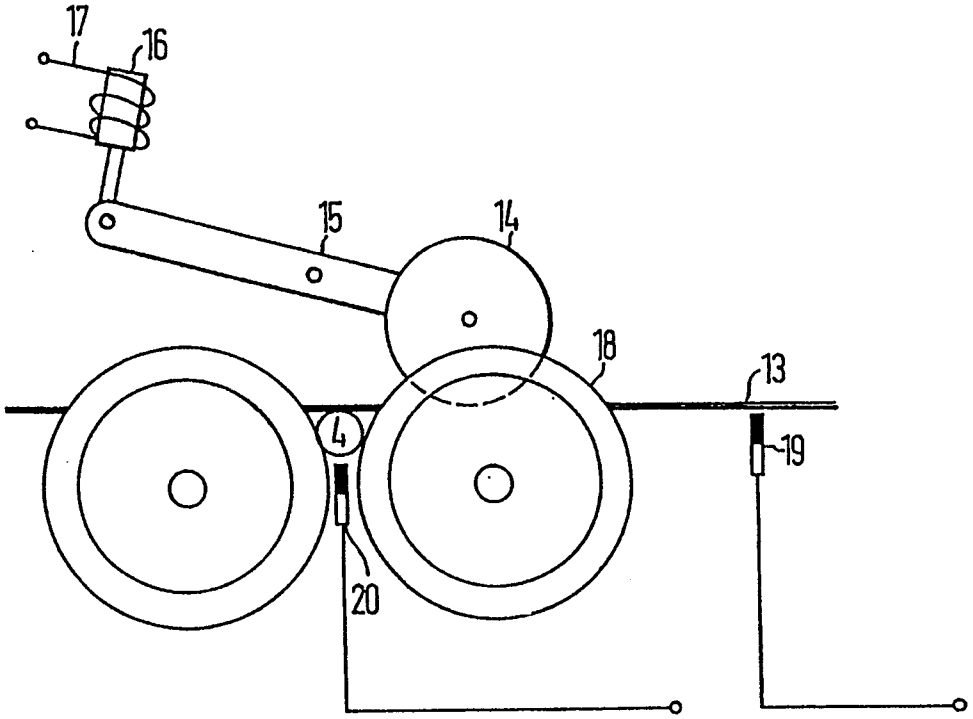
FIG. 3 shows an electro-mechanical adjusting element of the pressure roller in a group drive in which the rotors are driven by means of tangential belts.
Figure 3A:
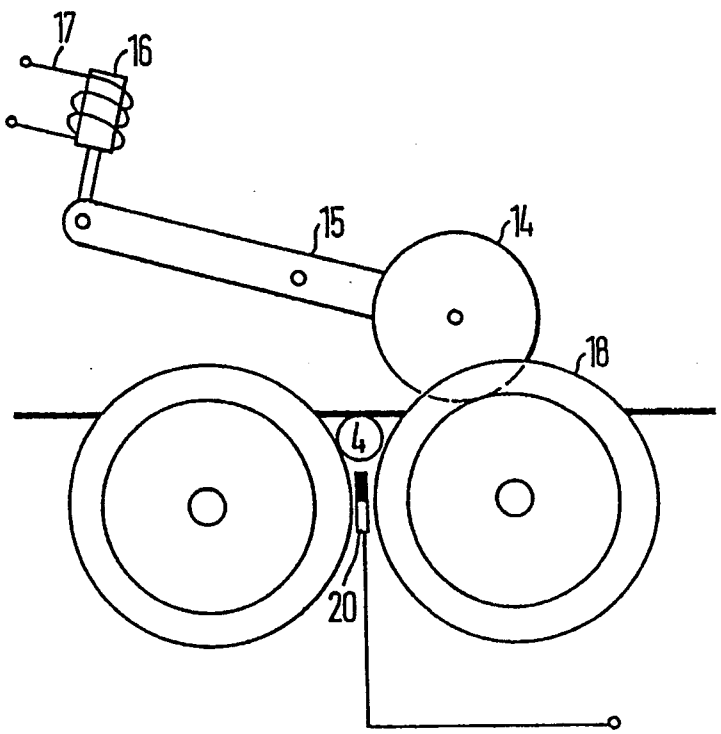

It is also possible to build an embodiment (FIG. 3) which drives several adjoining spinning elements simultaneously by means of a tangential belt 13 for an open-end spinning machine. In FIG. 3, the rotor drive of spin box A and spin box B is shown schematically and selectively. The connection to the respective control circuits is not shown. The individual pressure rollers 14 are assigned individual actuators which consist of magnet coil 17 and movable iron core 16. The pressure roller 14 is normally supported rotatably on one end of a swivelling lever 15. In the facing arm of the lever a rod with an iron core 16 is installed via an appropriate articulation mechanism. The iron core is supported inside the magnet coil 17. If the contact pressure is to be increased, the iron core 16 is pulled into the interior of the coil with a defined force so that the pressure roller 14 presses upon tangential belt 13 with a precisely defined force on basis of known lever ratios. If this contact pressure is to be reduced in a controlled manner, a change in the magnetic field caused by the controlling means causes the iron core to be pushed out of the interior of the coil in a defined manner. According to the process of the invention, actual values of the tangential-belt speed and of the rotational speed of the motor are detected and are processed into a difference in rotational speeds so that each spinning station can be controlled individually by its own control circuit (as described according to FIG. 2) so that a minimum energy consumption can be attained at all times. The advantage consists furthermore in a reduction of mechanical outlay required for control of a plurality of spinning rotors.

I claim:

1. A process for controlling driving of textile machine spinning elements during all operations in which they are driven through direct contact with a driven device, said process reducing the energy consumption required for operation of the spinning elements, said process comprising the steps of:

determining the actual rotational speed difference between a spinning element and the driven device; and varying the contact pressure between the spinning element and driven device as a function of the actual difference of the rotational speeds thereof.

2. The process as in claim 1, further comprising empirically determining an optimum set point rotational speed difference between the spinning element and driven device and comparing the actual rotational speed difference to the optimum set point rotational speed difference, and controlling the contact pressure as a function of the deviation between the actual difference and the optimum set point difference.

3. The process as in claim 2, further comprising determining the deviation between the actual rotational speed difference and optimum set point rotational speed difference with a control circuit which adjusts the contact pressure between the driven device and spinning element as a function of the determined deviation.

4. The process as in claim 2, wherein the contact pressure is increased if the deviation between actual rotational speed difference and optimum set point rotational speed difference is positive.

5. The process as in claim 2, wherein the contact pressure is decreased if the deviation between actual rotational speed difference and optimum set point rotational speed difference is negative.

6. The process as in claim 2, wherein the textile machine includes a plurality of spinning elements and wherein said process controls the contact pressure between each individual spinning element of the textile machine and individual driven devices associated with each individual spinning element.

7. The process as in claim 2, wherein the textile machine includes a plurality of spinning elements and wherein said process controls the contact pressure between each individual spinning element of the textile machine and a common driven device.

8. A textile machine having a spinning element driving control device for controlling contact pressure between a spinning element and an associated driven device through essentially all phases of operation of said spinning element, said device significantly reducing the energy consumption required for operation of the spinning element, said spinning element driving control device further comprising:

a contact pressure adjusting device, said adjusting device operably configured to maintain the contact pressure between said spinning element and said driven device; and control means operably configured with said adjusting device for varying the contact pressure between said spinning element and said associated driven device as a function of the actual rotational speed difference between the spinning element and the driven device.

9. The machine as in claim 8, wherein said control means comprises a comparator device for determining the deviation between the actual rotational speed difference of the spinning element and the driven device and a predetermined optimum set point rotational speed difference between the spinning element and the driven device.

10. The machine as in claim 9, further comprising an actuator device in communication with said comparator device and configured to adjust the contact pressure between said spinning element and said driven device as a function of said deviation between said actual rotational speed difference and said optimum set point rotational speed difference.

11. The machine as in claim 8, further comprising a speed sensor disposed so as to measure the rotational speed of said spinning element, and a speed sensor disposed so as to measure the rotational speed of said driven device, and a differencing circuit operatively configured with said sensors for determining said actual rotational speed difference between said spinning element and said driven device.

12. The machine as in claim 8, wherein said device is configured with a plurality of spinning elements wherein each spinning element has an associated individual driven device, said adjusting device configured to adjust the contact pressure between each spinning element and its associated individual driven device.

13. The machine as in claim 12, wherein said individual driven device includes a twin disk bearing, said adjusting device operably connected to said twin disk bearing so that said adjusting device acts upon said twin disk bearing in order to adjust the contact pressure.

14. The machine as in claim 13, wherein said adjusting device includes a valve with a movable piston, said piston acting against said twin disk bearing.

15. The machine as in claim 14, wherein said common driven device includes a tangential driving belt, said adjusting device acting upon said tangential driving belt.

16. The machine as in claim 15, wherein said adjusting device includes a mechanism for adjusting the pressure of a pressure roller relative said tangential belt.

17. The machine as in claim 16, wherein said mechanism includes an magnetic lifting device operably configured with said pressure roller for displacing said pressure roller relative said tangential belt.

18. The machine as in claim 8, wherein said device is configured with a plurality of spinning elements wherein each spinning element is driven by a common driven device, said adjusting device is configured to adjust the contact pressure between each spinning element and said common driven device common to a plurality of said spinning elements.

19. A textile machine, said machine comprising:

a plurality of spinning elements;

a driven device operably configured to contact said spinning elements for rotating said spinning elements;

adjusting means for adjusting the contact pressure between said spinning elements and said driven device;

control means operably configured with said adjusting device for varying the contact pressure between said spinning elements and said associated driven device as a function of the actual rotational speed difference between the spinning elements and the driven device.

20. The textile machine as in claim 19, wherein said control means comprises a comparator device for determining the deviation between the actual rotational speed difference of the spinning element and the driven device and a predetermined optimum set point rotational speed difference between the spinning element and the driven device.

* * * * *